United States Patent [19]

Neumann

[11] 4,080,220

[45] Mar. 21, 1978

[54] PROCESS AND APPARATUS FOR CLEANING THE DOOR OR DOOR FRAME OF A COKE OVEN

[75] Inventor: Hans Neumann, Salinas, Asturias, Spain

[73] Assignee: Dimisa Didier Ingenieria Y Montajes Industriales, S.A., Aviles, Spain

[21] Appl. No.: 749,895

[22] Filed: Dec. 13, 1976

[51] Int. Cl.[2] ..... B08B 7/00; C10B 43/04

[52] U.S. Cl. ..... 134/6; 15/93 A; 134/39; 202/241

[58] Field of Search ..... 134/6, 39; 15/93 A; 202/241

[56] References Cited

U.S. PATENT DOCUMENTS

| | | | |
|---|---|---|---|
| 3,056,699 | 10/1962 | Randell et al. | 134/6 |
| 3,464,074 | 9/1969 | Stanke et al. | 15/93 A |
| 3,633,233 | 1/1972 | McCullough | 15/93 A |
| 3,758,910 | 9/1973 | Lakeberg | 15/93 A |
| 3,822,191 | 7/1974 | Konno | 15/93 A |

FOREIGN PATENT DOCUMENTS

| | | | |
|---|---|---|---|
| 857,780 | 1/1961 | United Kingdom | 15/93 A |

*Primary Examiner*—Robert L. Lindsay, Jr.
*Assistant Examiner*—George C. Yeung
*Attorney, Agent, or Firm*—Wenderoth, Lind & Ponack

[57] ABSTRACT

A carriage is freely suspended, to be movable in all directions, from a cart movable along rails supported by a fixed coke guide car structure of a coke oven. The carriage has upper and lower drives which move grippers to grip the back of a door to be cleaned and to thus move the freely suspended carriage toward the door. Centering pieces on the carriage contact the edges of the door and center the carriage relative to the specific alignment of the door. The carriage carries a further drive which rotates spindles which cause cleaning instruments mounted thereon to move therealong to clean surfaces of the door.

12 Claims, 5 Drawing Figures

PROCESS AND APPARATUS FOR CLEANING THE DOOR OR DOOR FRAME OF A COKE OVEN

BACKGROUND OF THE INVENTION

The present invention relates to a process for cleaning the door or door frame of a coking furnace, and particularly to such a process wherein a carriage equipped with cleaning instruments is mounted on a coke guide car structure. The carriage is propelled towards the door or door frame, and after they have been aligned, the cleaning instruments are caused to act against the surfaces requiring cleaning. The present invention further relates to an apparatus with which to carry out the aforementioned process.

The cleaning of coking oven doors is necessary, since the operation of coking furnaces leads to the formation of incrustations which have a deleterious effect on the furnace and which specifically can lead, among other things, to leakages around the door. For this reason, it is common practice to clean the coking oven doors after every discharge from the furnace chamber before reusing the furnace. The principle difficulties which are encountered in mechanical cleaning operations relate mainly to the fact that satisfactory cleaning requires small tolerances between the surfaces to be cleaned and the cleaning instruments, while at the same time the displacement of the door and the movement of the carriage or rig carrying the cleaning instruments requires large tolerances.

The great height of the furnace door adds to the difficulties, as does the fact that the cleaning instruments must be applied with relatively great pressure in order to remove the crust formations. This pressure must not, however, be anywhere near great enough to cause deformation or other damage to the door or door frame elements.

German DT-AS No. 1,147,914 describes a device for cleaning the edge seal of a furnace door wherein, in order to align the rig to any given door opening, the rig is freely suspended about a horizontal axis of rotation. In addition, compression springs are provided to act in the direction of the center of rotation and to produce an elastic mounting of the rig and an elastic counter-pressure where the rig and door stoppers join. In this system the arrangement between rig and door is an improvement over a rigidly mounted rig. However, there still remains the difficulty that the height of the axis of rotation relative to the door must be exactly predetermined, since otherwise the cleaning of the upper and lower edge seals of the door is impaired. Another disadvantage is due to the fact that the springs continuously exert pressure when, in fact, during the actual cleaning operation a rigid combination of door and rig is desired.

German DT-OS No. 1,671,332 describes a device for cleaning a coking oven door wherein the rig carrying the cleaning instruments is mounted on a universal joint. This allows the rig to carry out light rocking movements, so that in the event of the door being tilted, the rig can adjust to the position of the coking oven door.

In this system also, the position of the rotating axes of the universal joint relative to the door must be exactly predetermined. This is difficult to achieve, since the tolerances between the position of the door and the rig drive mechanisms can be determined only with the greatest difficulties.

In all the existing systems and processes, it is disadvantageous that the rig for cleaning the coking furnace door must be driven or tracked against the door, and that there exists no direct connection between the carriage drive and the displaced or drafted door.

SUMMARY OF THE INVENTION

The object of the present invention is to provide a process and apparatus which assure that whatever the position of the door may be, the carriage with the cleaning instruments can be properly positioned so as to reach and uniformly contact the door and to retain this position during the cleaning operation.

This object is achieved according to the present invention in that the approaching motion between the carriage and the door is carried out by means of at least one driving mechanism which is on the carriage and which engages the door and in that the carriage, in a first phase of the approaching motion towards the door, has freedom of movement in all directions. In a second phase of the approaching motion centering devices and grippers of the carriage center and grip the door. At the end of the approaching motion, the door and the carriage become rigidly joined by means of centering devices and grippers, as well as the drive mechanism itself. The same procedure can be applied in connection with cleaning the door frame of the door.

By means of freely suspending the carriage, the latter can accommodate itself to the precise position of the door without the excessive tolerances between the respective positions of the carriage support and the door hoisting device causing a major problem. The centering and gripping devices ensure that the carriage assumes the proper position against the door. The drive mechanism operating between the door and the carriage assures that the carriage pulls itself against the door and remains connected to the door. Due to the fact that the carriage independently pulls itself towards the door, it is possible to use a simple control device and also to avoid the problem that shifting of the door after the approach of the carriage can lead to a displacement between the cleaning instruments and the door surfaces requiring cleaning.

The process of the invention may be an automatic operation.

In a preferred and specific embodiment of the apparatus of the invention, the door is gripped by devices located at the top and at the bottom of the door. In moving the carriage to the door, it is preferable that a drive mechanism causes the gripping devices to carry out swinging motions that reach behind and grip the door. The carriage is suspended by a cable and is attached to the drive mechanism that brings the carriage towards the door. The drive mechanisms cause the gripping devices to grip the door by means of a system of levers. The cable suspension of the carriage provides the advantage that the carriage, independent of the carriage mount, can easily adapt itself to any door position whenever the drive mechanism, by way of the lever system, pulls the carriage to the door.

It is advantageous to attach the cable to the carriage mount by way of springs. This allows adjustment of the position of the carriage with respect to the door with only a small expenditure of energy.

It is advantageous to connect the cable to a cart which runs on tracks attached to the coke guide car structure of the coke oven. This cart requires no individual drive and is pulled along the tracks whenever the cable is stressed or pulled by the drive mechanism.

BRIEF DESCRIPTION OF THE DRAWINGS

Other objects, features and advantages of the present invention will be apparent from the following description, taken with the accompanying drawings, wherein.

DETAILED DESCRIPTION OF THE INVENTION

Figure 2:
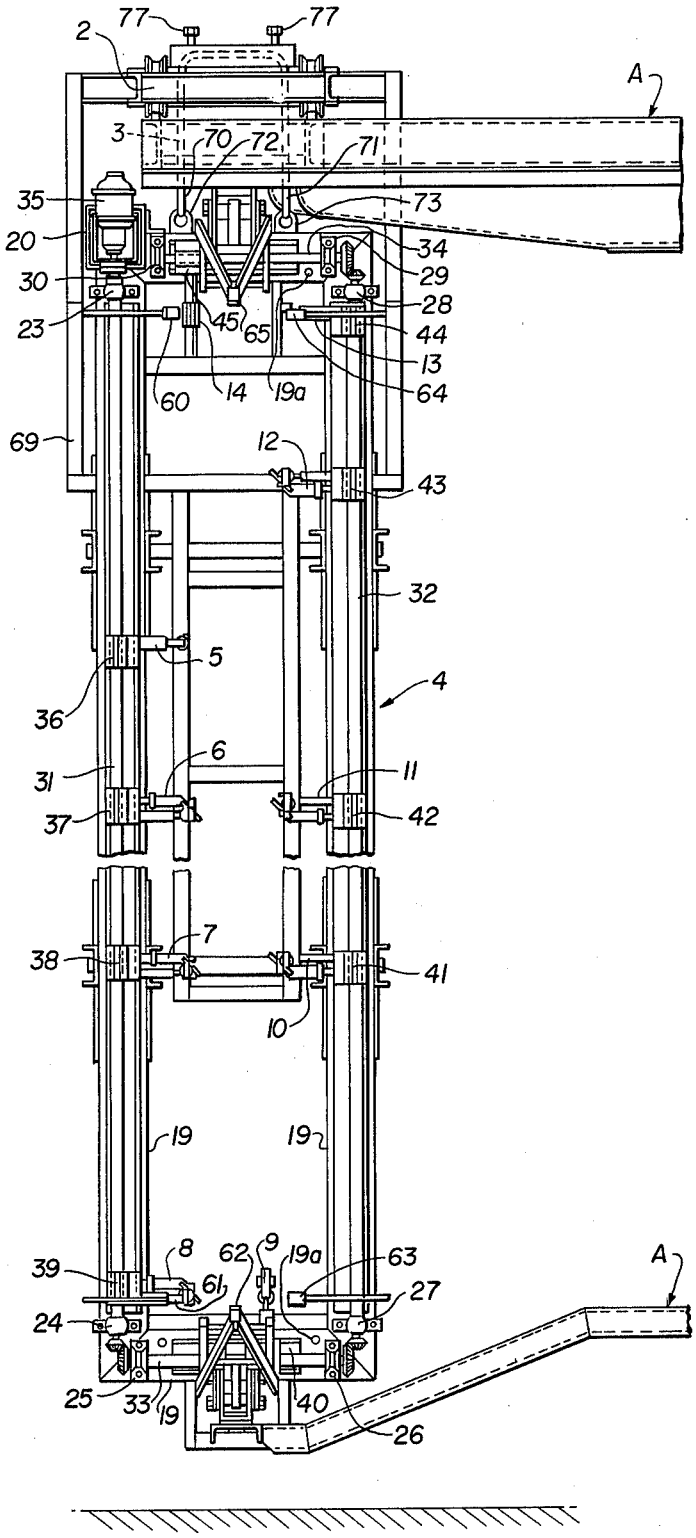
FIG. 2 is an elevation view taken substantially along line II—II of FIG. 1.
Figure 5:
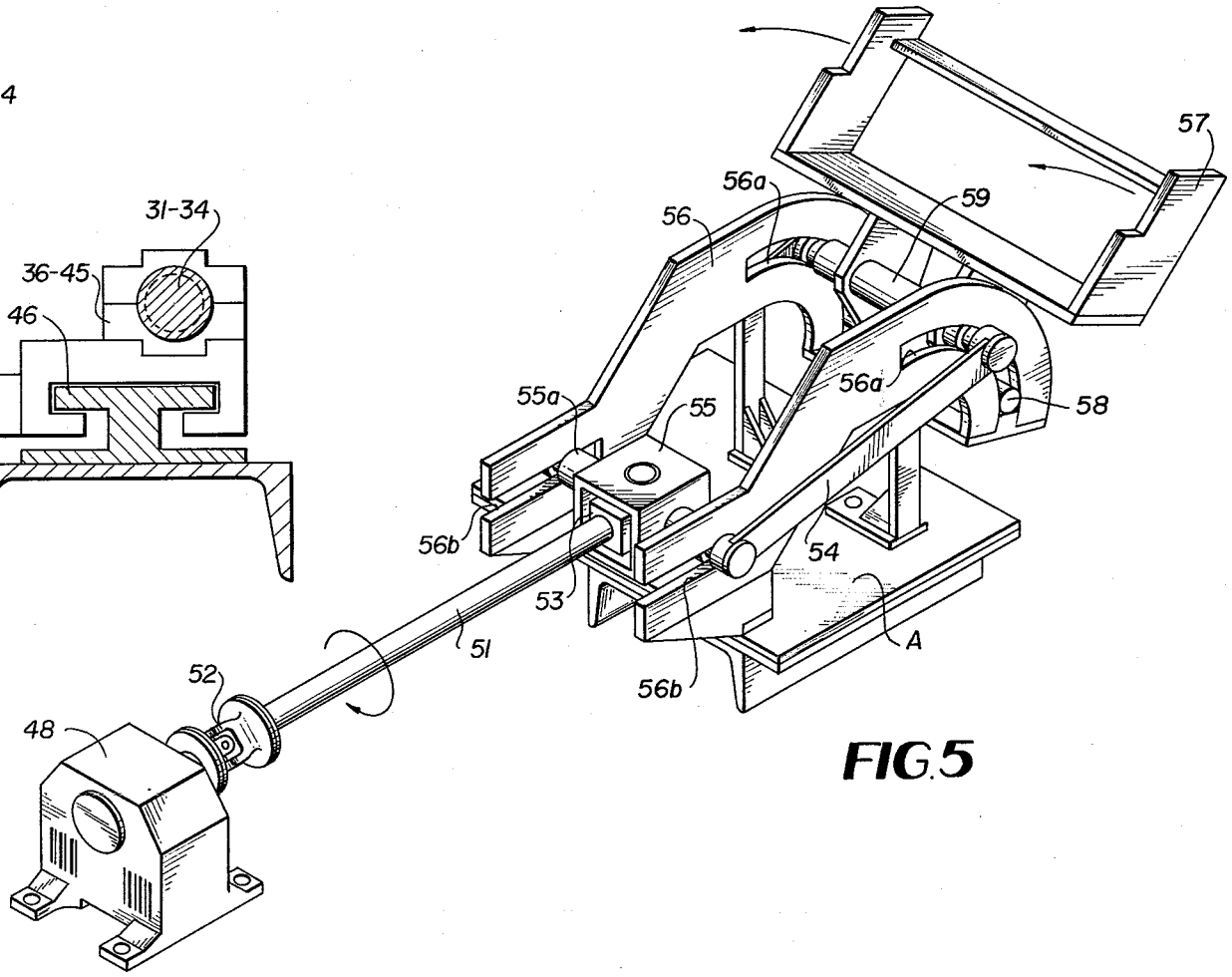
FIG. 5 is an enlarged perspective view of the motive or gripping system shown in FIG. 1.

Rigidly fixed adjacent a coke oven (not shown) is a coke guide car structure A. This structure is conventional, and thus only portions thereof are shown in FIGS. 2 and 5. Mounted above structure A are guide rails 1 along which is movable a cart 2. A carriage 4 is suspended from cart 2 via a flexible member such as cable 3. The carriage 4 supports a plurality of cleaning instruments or members 5 to 14.

The carriage 4 is formed by a frame 19 of generally rectangular configuration and to which are attached brackets 20, 21 and 22 and bearings 23 to 30. Bearing pairs 23, 24 and 27, 28 respectively support vertical worm gear spindles 31 and 32. Bearing pairs 25, 26 and 29, 30 respectively support horizontal worm gear spindles 33 and 34. An electric motor 35 is mounted on the bracket 20 and drives the threaded spindles 31 through 34. For this purpose, adjacent ends of the threaded spindles are joined via meshing beveled gears. On the threaded spindle 31 are threadedly mounted the guide support members 36 to 39 which respectively support the cleaning instruments 5 to 8. On the threaded spindle 33 is threadedly mounted the guide support member 40 to which is attached the cleaning instrument 9. Along the threaded spindle 32 are threadedly mounted guide support members 41 through 44 which respectively support the cleaning instruments 10 to 13. The threaded spindle 34 has threadedly mounted thereon the guide support member 45 to which is attached the cleaning instrument 14. Each of the guide support members are movably mounted on longitudinally extending sides of a generally rectangular slide 46 that extends along the frame 19, so that rotation of spindles 31 through 34 produces respective longitudinal displacement movements of the cleaning tools. For purposes of simple adjustment, the cleaning tools are spaced along the spindles.

The brackets 21 and 22 are cantilevered to frame 19 and respectively support electro-motors 47 and 48. The electric motor 47 operates an upper drive member 49, and electric motor 48 operates a lower drive member 50. Each of the drive members 49 and 50 include a threaded spindle 51, one end of which is coupled to the respective motor 47 or 48 via a universal joint 52. The other end of each threaded spindle 51 carries a threaded coupling 53 which is prevented from rotating by means of a guide brace 55. Rigidly connected to the coke guide car structure A are plates 56, each of which has an arcuate or curved slot 56*a* and a longitudinal slot 56*b*. Rod or roller 55*a*, connected to coupling 53 through brace 55, rides in slots 56*b* and is connected to arm 54 which carries a bolt 59 on which is mounted gripper or engaging element 57. A peg or rod 58 is attached to element 57 and rides in arcuate slots 56*a*. Bolt 59 also rides in slots 56*a*. Depending on the direction of rotation of spindle 51 by drive motor 48, coupling 53 is shifted to the right or left, as viewed in FIG. 5, and element 57 is lowered into a non-gripping position or raised in a gripping position. More specifically, movement of coupling 53 to the right moves element 57 to the position shown in FIG. 5. However, movement of coupling 53 to the left causes element 57 to be raised, due to bolt 59 and rod 58 riding in slots 56*a*.

Figure 1:
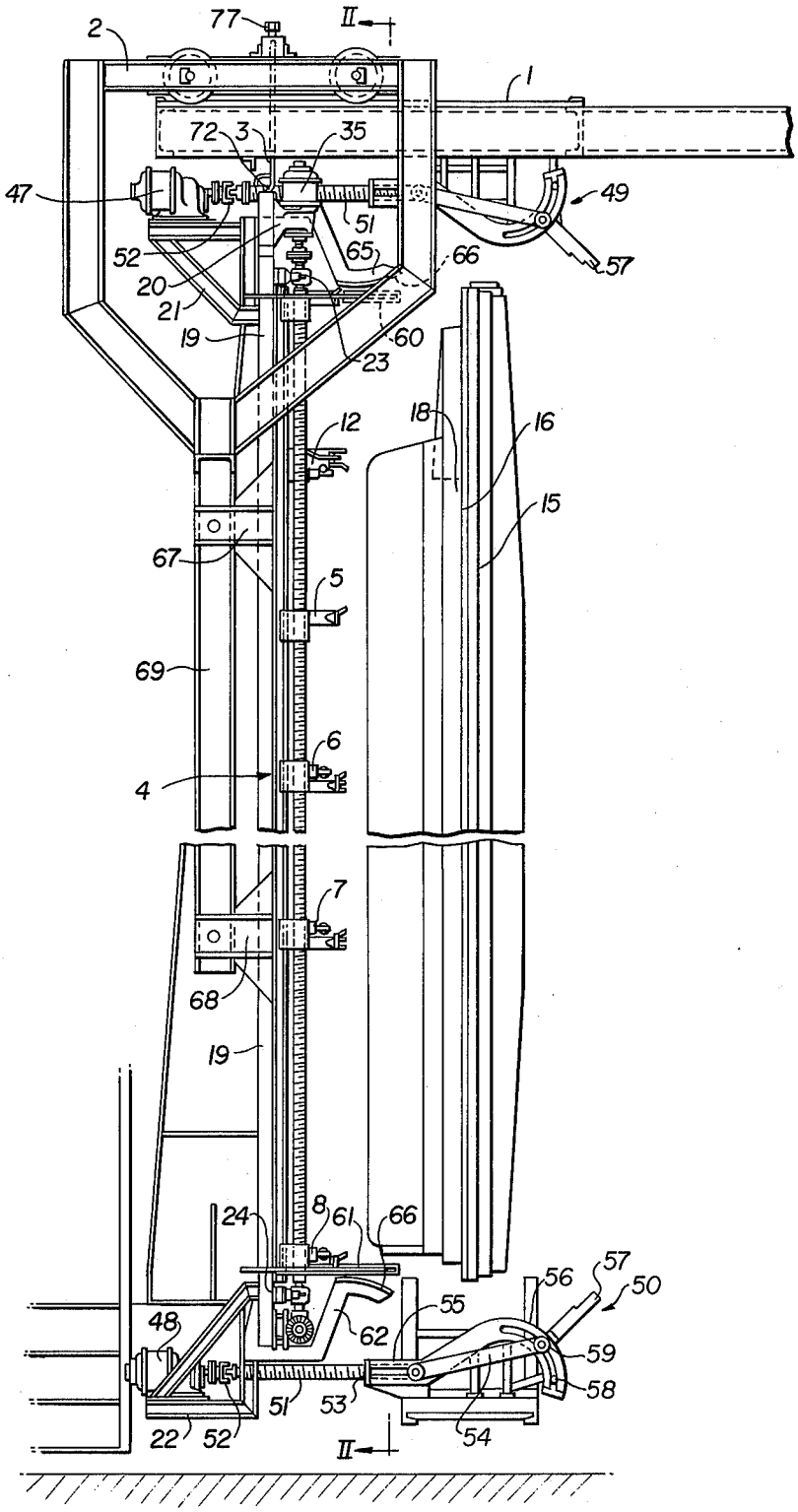
FIG. 1 is a side elevation view of a cleaning apparatus for a coke oven according to the invention.

Along the frame 19 of the carriage 4 are provided centering pieces 60 to 65. Centering pieces 60, 61 and 63, 64 are provided for aligning the longitudinal sides of the door with the carriage. Centering between the upper and lower surfaces of the carriage and door is performed by the centering pieces 65 and 62, respectively. More particularly, three centering pieces, i.e., 60, 65 and 64, are located at the upper portion of the carriage, and three centering pieces, i.e., 61, 62 and 63, are located at the lower portion of the carriage. Each of the centering pieces 60 to 65 has a curved alignment surface 66, as shown in FIG. 1 with regard to pieces 62 and 65, for facilitating centering.

Frame 19 of carriage 4 may be provided with spacers 19*a* to space carriage 4 from door 15 by a desired distance. Any suitable spacer structure may be employed. For instance, each spacer could be a pipe attached to frame 19. One or both ends of the pipe could be threaded to receive adjusting screws so that the spacing function could be adjustable. Preferably, the spacers are provided at the top and bottom portions of frame 19. Further, the spacers may be equipped with conventional switches so that when the door and carriage are desirably spaced, the respective motors 47 and 48 are shut off. Such switches could be conventional microswitches or conventional ampere-consumption relays which would shut off the motors in response to increased ampere consumption if the motor continued to operate after the door abutted with the spacers. Other types of conventional switches could also be used.

The frame 19 of the carriage 4 is equipped with bearing blocks or support members 67 and 68 which are connected, with a certain degree of free play, to a support 69 which is attached to cart 2. The free play is calculated to allow the carriage to adjust to all anticipated positions of the coke oven door and may be provided by various known mechanical expedients for obtaining free play between two interconnected members. For instance, members 67 and 68 may be attached to support 69 by means of rod-type connecting elements having a round cross-sectional configuration and fitting in recesses in members 67 and 68 or in support 69 having a non-round or non-circular configuration. Thus, free play between support 69 and members 67 and 68 would be possible.

Figure 3:
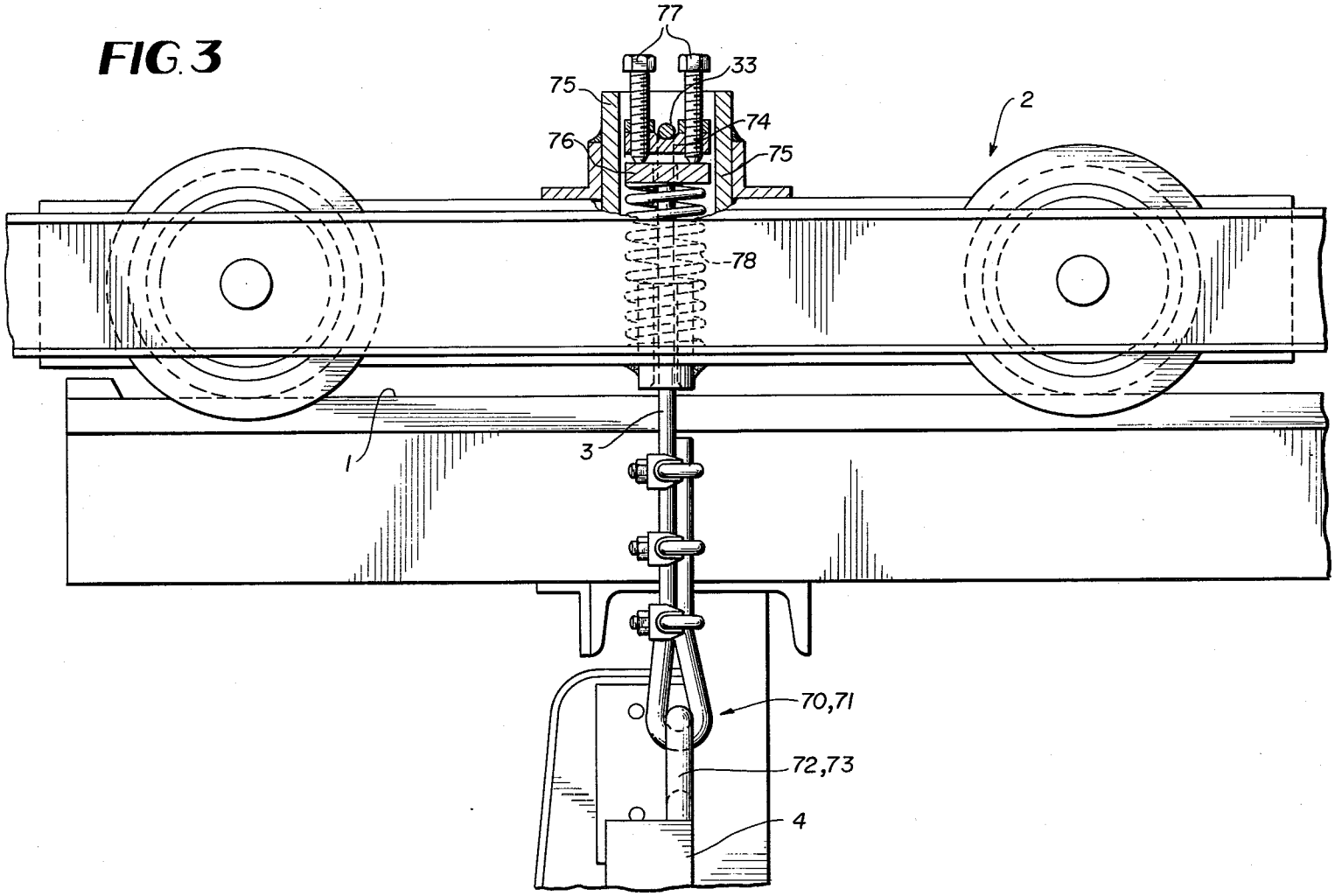
FIG. 3 is an enlarged elevation view, partially in section, of the guide and support system of FIG. 1.

Carriage 4 is supported by a cable 3 which has loops formed at opposite ends 70 and 71 thereof. The carriage 4 is suspended from the looped ends by means of carrying or reinforced eyelets 72 and 73 (see FIG. 2). The positioning of the cable 3 from cart 2 is shown in detail in FIG. 3. The cable is attached at a position between ends 70 and 71 to cart 2 by means of a supporter or supporting piece 74 which can be raised or lowered between guide jaws 75. The distance between supporter 74 and a plate 76 can be adjusted by means of screws 77 which are threaded into supporter 74 and which rest against plate 76. The plate 76 rests on first ends of compression springs 78, only one of which can be seen in FIG. 3. The other ends of compression springs 78 contact the cart 2. The compression springs take up the weight of the carriage 4 by way of cable 3, the supporting piece 74, the screws 77 and the plate 76. The intermediate height of the carriage 4 can be adjusted by means of the screws 77.

Figure 4:
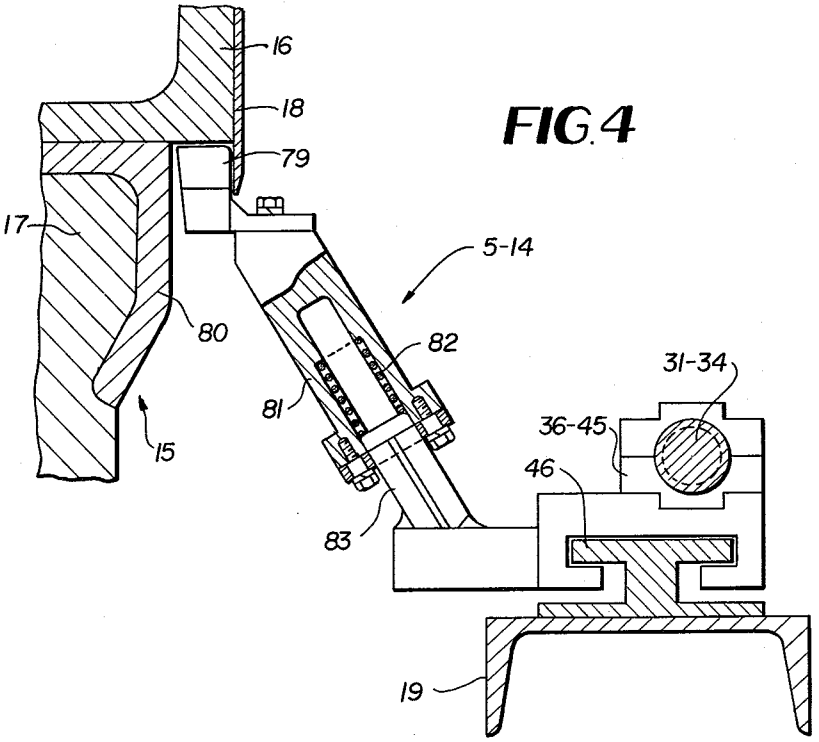
FIG. 4 is an enlarged section illustrating the relationship of a cleaning instrument in operative position for cleaning the coke oven door.

FIG. 4 illustrates a specific arrangement or structure of any one of the cleaning instruments 5 to 14. The cleaning instrument has a scraping edge 79 which scrapes or cleans the area between the door body 16, sealing members 18, and support bracket 80 of the door stopper 17. The scraping edge or member 79 is attached to a scraper holder 81 so as to be easily exchangeable. The scraper holder 81 is mounted on a carrier member 83 with a compression spring 82 therebetween. Carrier 83 is welded onto the corresponding support member 36 to 45. The carrier 83 and the scraper holder 81 extend at an angle of approximately 60° from the plane of the carriage frame 19 to the door frame 16.

The operation of the door cleaning process described above is as follows.

After the door 15 has been lifted out of its door frame along the coke oven chamber by means of a conventional hoist and has been turned around its longitudinal axis by 90°, it comes to rest at the position shown in FIG. 1.

In order to clean the door, the cleaning instruments 5 to 14 must be moved towards the door, and thus the electric motors 47 and 48 are switched on. Starting from the position shown in FIG. 1, motors 47 and 48 cause the initial motion of the threaded spindles 51 to move the respective grippers 57 to turn in the direction of the upper and lower door edges, respectively. This causes the door to be engaged from behind, or from the right as shown in FIG. 1, by the grippers 57. As soon as the grippers 57 make contact with the door, the carriage 4 begins to move towards the door 15 due to the rotation of the threaded spindles 51. The cart 2 follows this motion along rails 1 due to blocks 67 and 68 and support 69.

During this approaching movement, the door edges come in contact with the centering surfaces 66 of the centering pieces 60 to 65, and the position of carriage 4 will thus be adjusted relative to any given door position. The connection between the blocks 67 and 68 and support 69, as well as universal joints 52, is so designed as to allow in all cases sufficient play to allow this adjustment. If major deviations of the angular position of the door in the direction of the height of the door are to be encountered, then a large amount of play can be calculated and provided accordingly.

By suspending the carriage 4 from the cable 3, it becomes possible for the carriage 4 to freely pull itself towards the door 15 in all directions of motion. Angular displacements of the door around the longitudinal axis thereof as well as angular displacements around the transverse axis thereof can be compensated for by means of this cable type suspension. The mounting of the cable 3 via the compression springs 78 allows for the adaptation of the carriage 4 to deviations in the position of the door with very slight expenditure of power.

As soon as the carriage 4 has been brought, by the respective grippers 57, to the proper distance from the door 15, at the top or at the bottom thereof, then the respective upper or lower motor is switched off. The spacing between the final positions of the carriage and door is determined by respective upper or lower spacers **19*a* attached to the carriage. The other motor 47 or 48 is then switched off when the respective gripper has achieved the proper spacing between the door and the carriage. At that point, the threaded spindles 31 to 34 that carry the cleaning instruments 5 to 14 will rest parallel to the door surfaces requiring cleaning, and the cleaning instruments 5 to 14 will all contact the door surfaces to be cleaned with equal pressure. This condition is assured by the fact that the carriage 4 is firmly clutched to the door by means of the centering pieces 60 to 65**.

The motor 35 is then switched on and rotates the threaded spindle 31, which in turn drives the threaded spindle 33, which drives the threaded spindle 32, which drives the threaded spindle 34. As a result, the cleaning instruments are synchronously moved in a desired manner. For example, the cleaning instruments 5 to 8 move upwards, the cleaning instrument 9 moves towards the left, the cleaning instruments 10 to 13 move downward, and the cleaning instrument 14 moves to the right, as shown in FIG. 2. The compression springs 82, by which the cleaning instruments are mounted on the respective support members, ensure that even limited slippage or dislocations of the surfaces requiring cleaning can be compensated for. The pitch of the worm portions of the threaded spindles 31 to 34 and the ratios of the teeth of the bevel gears joining the spindles are designed to provide that all of the cleaning instruments reach the ends of the respective surfaces to be cleaned at the same time.

In the case of additional surfaces requiring cleaning by the cleaning instruments, it is possible to modify the structure of the cleaning instrumentation accordingly.

After the completion of the cleaning process, the motor 35 is switched off, e.g. automatically. The motors 47 and 48 are then switched on in the opposite direction from that described above. In practice, the power required to overcome the resistance of the bolts 59 of the grippers 57 in the slots **56*a* is less than the power needed to release the centering pieces 60 to 65 from the door 15. Accordingly, the grippers 57 will release the door first. Subsequently, additional rotation of the spindles 51 will cause the carriage 4 to be pushed away from the door while simultaneously taking along the cart 2. The carriage 4** moves away from the door until it reaches its initial starting position. The door, which has been cleaned along its right, left, upper and lower sealing edges, can then be returned into the door frame by means of the hoisting device.

In the above described installation, it is particularly advantageous that the cable, which is mounted by means of compression springs 78, allows the carriage 4 to move absolutely free. The carriage can thus, with a minimum of energy requirements, be moved in any necessary direction. Accordingly, even if the door has been subjected to a major displacement, it will be possible to have the cleaning instruments perform a parallel approach to the door edges and to assure equal contact pressure by the cleaning instruments on the respective surfaces to be cleaned.

In place of the electro-motor drives for the cleaning instruments and for the grippers, it is possible to provide other conventional drives, such as hydraulic drives.

The above described process and apparatus can also be employed to clean the door frame of a coke oven. The cleaning of a door frame is actually simpler than the cleaning of a door, since there is no need to account for gaps or tolerances caused by the door hoisting machinery.

It will be apparent that various modifications may be made to the above specifically described procedure and structural arrangement without departing from the scope of the invention.

What is claimed is:

1. A process for cleaning a door or door frame of a coke oven, said process comprising:

providing a freely suspended carriage having thereon movable cleaning instruments for cleaning surfaces of a door or door frame;

positioning said carriage at a position spaced from a door or door frame to be cleaned;

operating at least one drive mechanism on said carriage to move said carriage toward said door or door frame, said step of moving said carriage comprising:

moving said carriage through a first approaching phase toward said door or door frame while maintaining said carriage freely suspended and movable in all directions;

moving said carriage through a second approaching phase toward said door or door frame while centering said carriage with respect to said door or door frame by means of centering pieces and at least one gripper on said carriage and contacting said door or door frame; and moving said carriage to a rigid cleaning position against said door or door frame whereat said cleaning instruments are aligned with respective surfaces to be cleaned and whereat said cleaning instruments contact said respective surfaces with equal pressure; and thereafter moving said cleaning instruments along said respective surfaces to clean said surfaces.

2. A process as claimed in claim 1, wherein said gripper contacts and grips said door from the side thereof spaced away from said carriage.

3. A process as claimed in claim 2, wherein separate drive mechanisms are operated, one each on the top and the bottom of said door, each said drive mechanism having a separate gripper.

4. A process as claimed in claim 3, wherein said grippers move through a swinging motion toward and into contact with said door.

5. An apparatus for cleaning a door or door frame of a coke oven, said apparatus comprising:

a carriage having thereon cleaning instrument means for cleaning surfaces of a door or door frame;

means for freely suspending said carriage so that said carriage is freely movable in all directions, said suspending means comprising a cart movably mounted on guide rails, a flexible cable suspended from said cart and attached to said carriage, and spring means positioned between said cart and said cable for urging said cable and said carriage upwardly;

means, including at least one drive mechanism mounted on said carriage and having a gripper which is movable by said drive mechanism into a position gripping said door, for moving said carriage from a position spaced from a door or door frame to be cleaned toward said door or door frame through a first approaching phase whereat said carriage is maintained freely suspended and movable in all directions, and then through a second approaching phase while centering said carriage with respect to said door or door frame, and to a final cleaning position whereat said carriage and said door or door frame are rigidly connected and whereat said cleaning instrument means are aligned with and contact with equal pressure respective surfaces to be cleaned; and means, mounted on said carriage, for moving said cleaning instrument means along said respective surfaces to clean said surfaces.

6. An apparatus as claimed in claim 5, further comprising a support attached to said cart, and bearing blocks attached to said carriage, said bearing blocks being attached to said support with free play therebetween.

7. An apparatus as claimed in claim 5, comprising two said drive mechanisms each having a separate gripper, one of said drive mechanisms being positioned on an upper portion of said carriage, and the other of said drive mechanisms being positioned on a lower portion of said carriage.

8. An apparatus as claimed in claim 5, wherein said gripper is movable in a curved path to a position gripping said door at a side thereof spaced away from said carriage.

9. An apparatus as claimed in claim 5, wherein said means for centering comprises centering pieces attached to said carriage.

10. An apparatus as claimed in claim 5, wherein said cleaning instrument moving means comprises threaded spindles mounted on said carriage, said cleaning instruments being threadably mounted on respective of said spindles, and drive means mounted on said carriage for rotating said spindles and thereby moving said cleaning instruments longitudinally along respective said spindles.

11. An apparatus as claimed in claim 5, further comprising spring means for urging each of said cleaning instruments against the respective surface to be cleaned thereby.

12. An apparatus as claimed in claim 5, wherein each said cleaning instrument comprises a scraping member and a scraper support attached to said scraper member, each said scraper support extending from said carriage to the respective surface to be cleaned at an angle inclined to the plane of said carriage.

* * * * *